US005467975A

United States Patent [19]

Hadimioglu et al.

[11] Patent Number: 5,467,975

[45] Date of Patent: Nov. 21, 1995

[54] APPARATUS AND METHOD FOR MOVING A SUBSTRATE

[75] Inventors: Babur B. Hadimioglu, Mountain View; Martin G. Lim, Union City; Richard G. Stearns, Los Gatos; Calvin F. Quate, Stanford, all of Calif.

[73] Assignee: Xerox Corporation, Rochester, N.Y.

[21] Appl. No.: 316,343

[22] Filed: Sep. 30, 1994

[51] Int. Cl.[6] ..... B65H 5/12

[52] U.S. Cl. ..... 271/267; 271/84; 198/771

[58] Field of Search ..... 198/741, 771, 198/772; 271/193, 18.1, 18.2, 264, 267, 84

[56] References Cited

U.S. PATENT DOCUMENTS

| | | | |
|---|---|---|---|
| 2,442,839 | 6/1948 | Carlson | 271/267 |
| 3,276,774 | 10/1966 | Hunter | 198/772 |
| 3,667,590 | 6/1972 | Mead | 198/771 |
| 3,929,221 | 12/1975 | Armstrong | 271/267 |
| 4,050,572 | 9/1977 | Armstrong | 198/771 |
| 5,071,113 | 12/1991 | Nakamura et al. | 271/193 |
| 5,233,257 | 8/1993 | Luthier et al. . | |

FOREIGN PATENT DOCUMENTS

| | | | |
|---|---|---|---|
| 0252510 | 12/1985 | Japan | 198/771 |
| 0008150 | 1/1989 | Japan | 271/267 |

OTHER PUBLICATIONS

Racine, G. A., et al., "Hybrid Ultrasonic Micromachined Motors", Proc. IEEE Conf. on MEMS, Florida, Feb., 1993, pp. 128–132.

Uchiki, Tatsuya, et al., "Ultrasonic Motor Utilizing Elastic Fin Rotor", Japanese Journal of Applied Physics, vol 30, No. 9B, Sep., 1991, pp. 2289–2291.

Flynn, Anita M., et al., "Piezoelectric Micromotors For Microrobots", Journal of Microelectromechanical Systems, vol. 1, No. 1, Mar., 1992, pp. 44–51.

Udayakumar, R. M., et al., "Ferroelectric Thin Film Ultrasonic Micromotors", Proc. MEMS '91, Nara, Japan, Jan. 30–Feb. 2, 1991, pp. 109–113.

Moroney, R. M., et al., "Ultrasonic Micromotors", 1989 Ultrasonics Symposium, IEEE, pp. 745–748.

*Primary Examiner*—H. Grant Skaggs
*Attorney, Agent, or Firm*—Oliff & Berridge

[57] ABSTRACT

A device for moving an object, such as a sheet of paper or other substrate, includes a base element, a drive mechanism to move the base element in first and second directions, such as by vibration, and a plurality of flexible ratchets fixedly secured to the base element. As the base element vibrates, the ratchets advance the sheet of paper in a direction perpendicular to the direction of vibration of the base element. Pluralities of base elements and drive mechanisms can be provided to direct movement of the substrate in various directions.

19 Claims, 9 Drawing Sheets

APPARATUS AND METHOD FOR MOVING A SUBSTRATE

BACKGROUND OF THE INVENTION

1. Field of the Invention

The invention relates to devices and methods for moving substrates and other objects, and more particularly, for moving sheets of paper using ratchets secured to a vibrating base element.

2. Description of Related Art

Devices for moving substrates, such as sheet feeders in printers and photocopying machines, commonly are used to move a sheet of paper into a position suitable for printing. Typically, a plurality of spaced rollers engage the sheet and move it into a desired position relative to a printing area. Directional control of the sheet typically is accomplished by moving the supports on which the rollers are mounted, and/or skewing the rollers on their supports.

Such devices, however, generally require drive motors for rotating the rollers and moving the frames that support the rollers. These drive motors often are relatively massive, generate large amounts of thermal energy, and have large power requirements. Further, these devices advance sheets at relatively slow speeds and lack precision in advancing sheets into a desired position.

A need has arisen, therefore, for devices and methods that advance substrates at high speed and precision, while affording greater compactness and efficiency.

SUMMARY OF THE INVENTION

To overcome these and other disadvantages, one embodiment according to the invention includes a device for moving an object, the device including a base element, a drive mechanism coupled with the base element to move the base element in first and second directions, and a plurality of movable members fixedly secured to the base element. The members are in contact with the object such that movement of the base element in the first direction causes the members to change configuration to move the object in a direction other than the first direction, and such that movement of the base element in the second direction causes the members to reverse the change in configuration and to slip with respect to the object.

The movable members preferably include resiliently deformable members. According to one embodiment, the drive mechanism comprises a vibrator, such as a piezo-vibrator, that vibrates the base element. Preferably, at least 100 movable members are fixedly secured to the base element, and each movable member is less than 1 mm in length. The movable members preferably are formed of a material deposited in an evaporated state at an oblique angle onto the base element, or are formed of an electrodeposited material.

According to another embodiment of the invention, a bank of drive units is disposed with respect to a substrate to advance the substrate. Each of the drive units includes a support member mounted for vibratory movement, a vibrator coupled with the support member to vibrate the support member, and ratchet means coupled with the support member for engaging the substrate to advance the substrate as the support member vibrates. A controller directs the support member of a first of the drive units to vibrate out of phase with the support member of a second of the drive units so that the first drive unit advances the substrate out of phase with the second drive unit. A plurality of banks of drive units preferably are provided and are arranged to advance the substrate in different directions.

According to a particular embodiment, a bank of drive units includes at least three drive units, the support member of each drive unit vibrating out of phase with the support members of the other drive units.

Preferably, the ratchet means for engaging the substrate is frictionally engaged with the substrate as the vibrator moves the support member toward the substrate and is slidably engaged with the substrate as the vibrator moves the support member away from the substrate.

A method according to an embodiment of the invention includes engaging an object to be moved with a plurality of movable members fixedly secured to a base element, moving the base element in a first direction to change the configuration of the movable members, thereby causing the object to move in a direction other than the first direction, and moving the base element in a second direction to reverse the change in configuration of the movable members thereby causing the movable members to slip with respect to the object.

The method preferably further comprises the steps of engaging the object with pluralities of movable members, each being fixedly secured to one of a plurality of base elements, moving a first base element toward the object to move the object in a direction other than the first direction, and moving a second base element away from the object simultaneously with the step of moving the first base element.

These and other features of the invention are described in or apparent from the following Detailed Description of Preferred Embodiments.

BRIEF DESCRIPTION OF THE DRAWINGS

Preferred embodiments are described with reference to the drawings, in which like reference numerals denote like elements throughout the figures, and in which.

DETAILED DESCRIPTION OF PREFERRED EMBODIMENTS

Devices and methods for moving objects according to embodiments of the invention are not limited to sheet feeding applications in printing and photocopying devices. On the contrary, embodiments of the invention are usable in a wide variety of applications, such as semiconductor wafer handling and other applications. Embodiments of the present invention thus are not limited to paper feeding applications, although the invention is particularly well suited to such applications. Thus, while embodiments of the invention periodically will be described with reference to paper or other substrate feeding applications, the invention is not limited to these embodiments.

Figure 1:
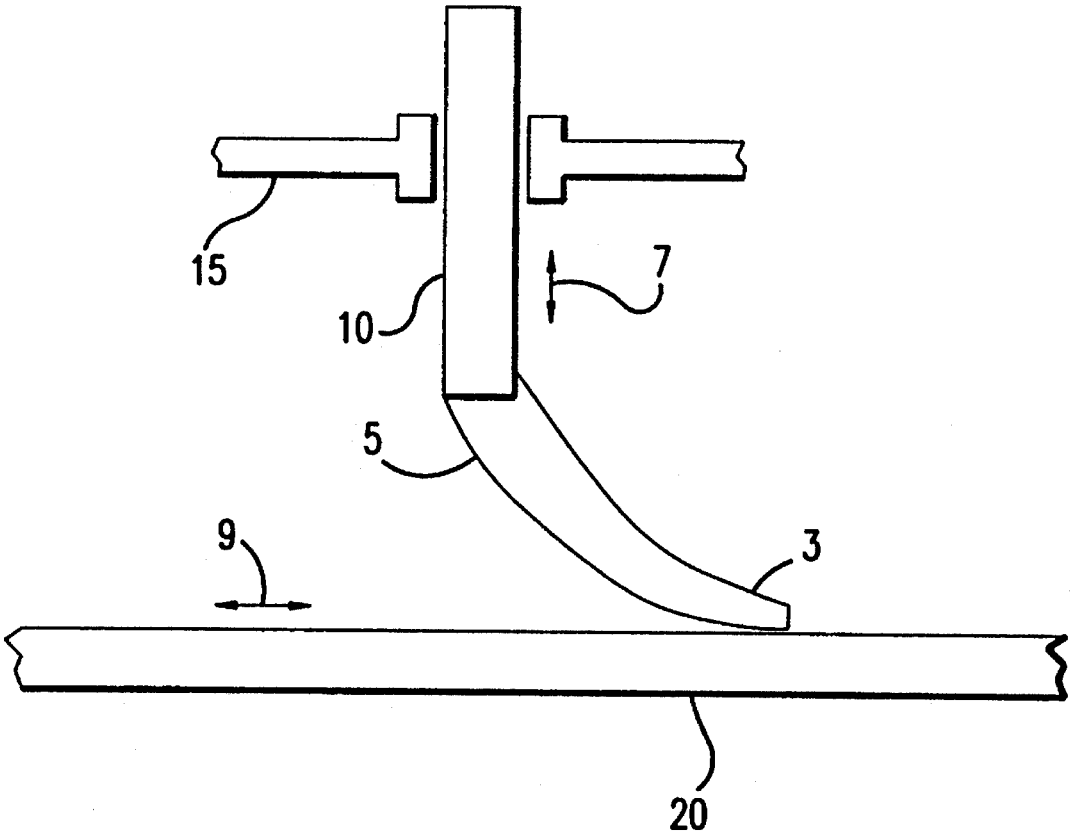
FIG. 1 is a front view of a ratchet and plunger arrangement according to an embodiment of the invention.

FIG. 1 illustrates a reciprocating movable member according to an embodiment of the invention. Movable member 5, which preferably is a resiliently deformable ratchet, is fixedly secured at one end to a support member, that is, to base element 10. In this embodiment, base element 10 is a vertically movable element slidably supported for vertical movement by support frame 15. The opposite end 3 of ratchet 5 contacts object 20, which preferably is a sheet of paper or other substrate. As a drive mechanism connected to base element 10 (not shown in FIG. 1) reciprocates base element 10 in the direction of arrows 7 perpendicular to paper 20, ratchet 5 is resiliently deformed, such as by bending. Consequently, the opposite end 3 of ratchet 5 reciprocates horizontally in the direction of arrows 9.

Ratchet 5 is constructed and arranged so that as base element 10 moves toward object 20, base element 10 resiliently deforms from an original configuration. Specifically, ratchet 5 is bent against object 20, causing end 3 of ratchet 5 to exert a linear force on object 20, from left to right as viewed in FIG. 1. FIG. 1 illustrates base element 10 at the extreme of its motion toward object 20, at which ratchet 5 is bent to its maximum extent. As base element 10 moves away from object 20, ratchet 5 begins to straighten, returning toward its original configuration.

Ratchet 5 exerts a nominal linear force on object 20 as base element 10 is withdrawn. That force, however, is negligible compared to the force exerted on object 20 as base element 10 moves toward object 20. Due both to the angle of contact between ratchet 5 and object 20 and to the length of ratchet 5, the force on object 20 as ratchet 5 moves from left to right in FIG. 1 exceeds the force on object 20 when ratchet 5 moves from right to left. Thus, with successive reciprocations of base element 10, ratchet 5 advances object 20 from left to right.

Although the support member, that is, base element 10, can be a plunger as in the previous embodiment, alternative support members also can be used, as will be described with reference to FIGS. 2–5. FIGS. 2–5 show more specific applications of the FIG. 1 embodiment.

Figure 2:
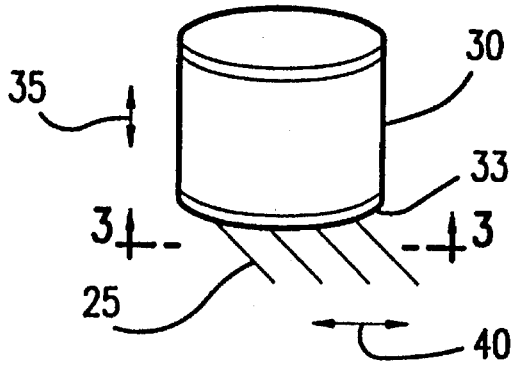
FIG. 2 is a perspective view showing a piezo-vibrator according to an embodiment of the invention.
Figure 3:
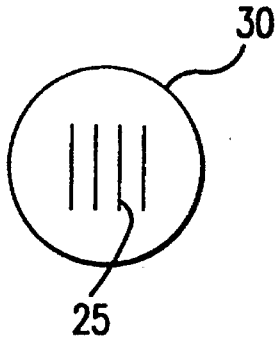
FIG. 3 is a bottom cross-sectional view along line 2—2 of FIG. 2.

According to the embodiment of FIGS. 2–3, base element 33 supporting ratchets 25 is connected to a piezoelectric-vibrator-type drive mechanism 30. As is known in the art, applying an electric signal to a crystal or ceramic of a piezo-vibrator produces a vibration at a desired frequency. In this embodiment, applying an electric signal to piezoelectric vibrator 30 vibrates base element 33 in the direction of arrows 35. Consequently, the free ends of ratchets 25 move in the direction of arrows 40 to linearly advance an object from left to right, as described with respect to the FIG. 1 embodiment.

Specifically, as base element 33 moves toward a substrate, ratchets 25 are resiliently deformed from an original configuration, such as by bending, to move the substrate in an advancement direction preferably perpendicular to the direction of movement of base element 33. Movement of the substrate in other directions is also possible, however, depending on the structure on which the substrate is supported, for example.

As base element 33 moves away from the substrate, ratchets 25 move toward their original configuration and slip with respect to the substrate. Although ratchets 25 preferably slip with respect to the substrate by sliding along the substrate, ratchets 25 also can slip by skipping along the substrate, by moving while entirely out of contact with the substrate, or by moving with respect to the substrate in some other manner.

Piezoelectric vibrator 30 preferably vibrates base element 33 at approximately 100 KHz–1 MHz. According to preferred embodiments, each ratchet 25 is approximately 10–100 microns long, although lengths of up to at least several millimeters also are possible. Further, base element 33 preferably supports hundreds of ratchets, although base element 33 also may support fewer ratchets.

Figure 5:
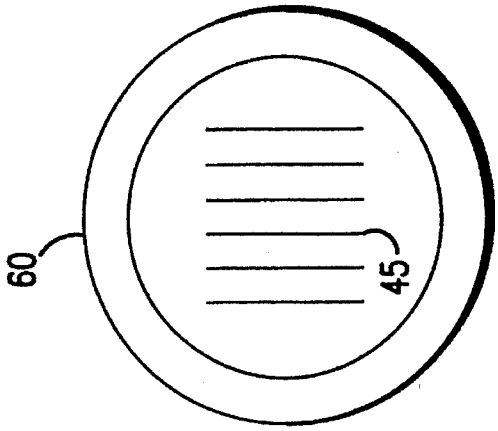
FIG. 5 is a bottom cross-sectional view along line 5—5 of FIG. 4.
Figure 4:
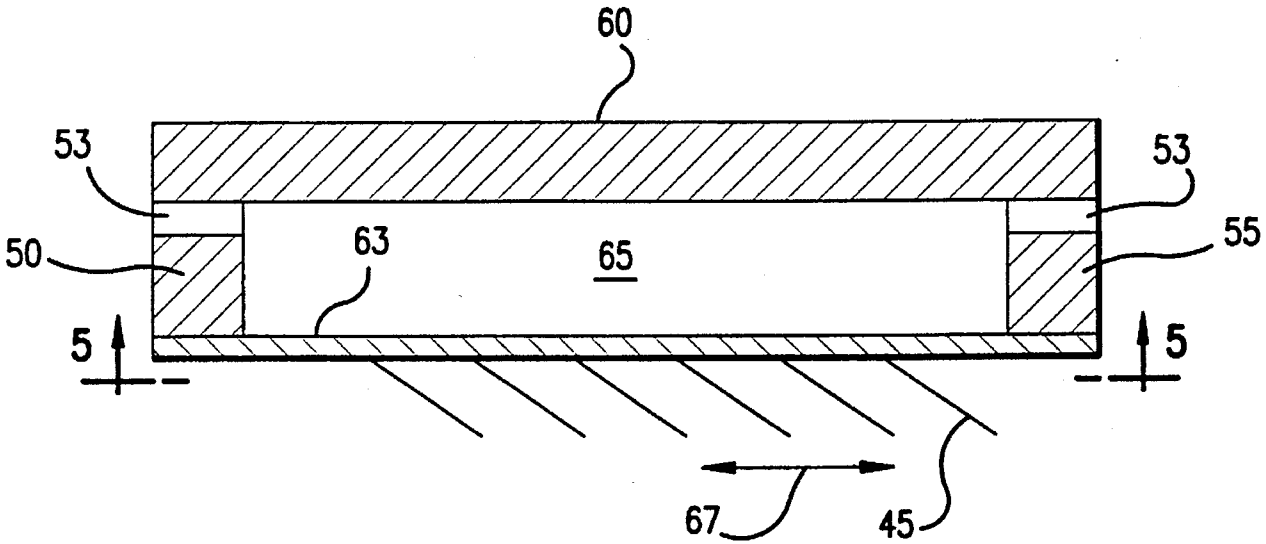
FIG. 4 is a cross-sectional view of a vibrator according to another embodiment of the invention.

FIGS. 4–5 illustrate another embodiment according to the invention. Ratchets 45 are supported on base element 63, which preferably is a diaphragm formed of a membrane or other type of thin layer. Base element 63 preferably is at least partially conductive, for example by metallizing the side of base element 63 opposite ratchets 45 or by forming the membrane of a conductive material. In a particular embodiment, a piezoelectric film such as ZnO is deposited on the membrane. Placing a voltage across the piezoelectric film, with suitable metal electrodes, for example, causes the piezoelectric film to expand and deform the membrane.

Base element 63 extends between ends 50, 55 of a drive mechanism such as vibrator 60. Ends 50, 55 preferably are insulated from the remainder of vibrator 60 by gap 53 of a selected width. Vibrator 60 generates an alternating electromagnetic field in space 65 causing base element 63 to vibrate, preferably at its natural resonant frequency. Alternating voltage between base element 63 and vibrator 60 causes vibrator 60 to vibrate. Space 65 preferably is a dielectric gap between base element 63 and vibrator 60, forming a capacitor-like structure.

In a manner similar to that of the previous embodiment, vibration of base element 63 causes the ends of ratchets 45 to move in the direction of arrows 67 to advance a substrate or other object. Base element 63 preferably supports hundreds of ratchets 45, each of which preferably is 10–100 microns long. Further, base element 63 preferably is formed of silicon, silicon dioxide, silicon nitrite, or metals such as electroplated nickel.

Although piezoelectric vibrator 30 of FIGS. 2–3 and vibrator 60 of FIGS. 4–5 are cylindrical, a variety of other shapes, including square, rectangular and polygonal shapes, also are possible.

Figure 6:
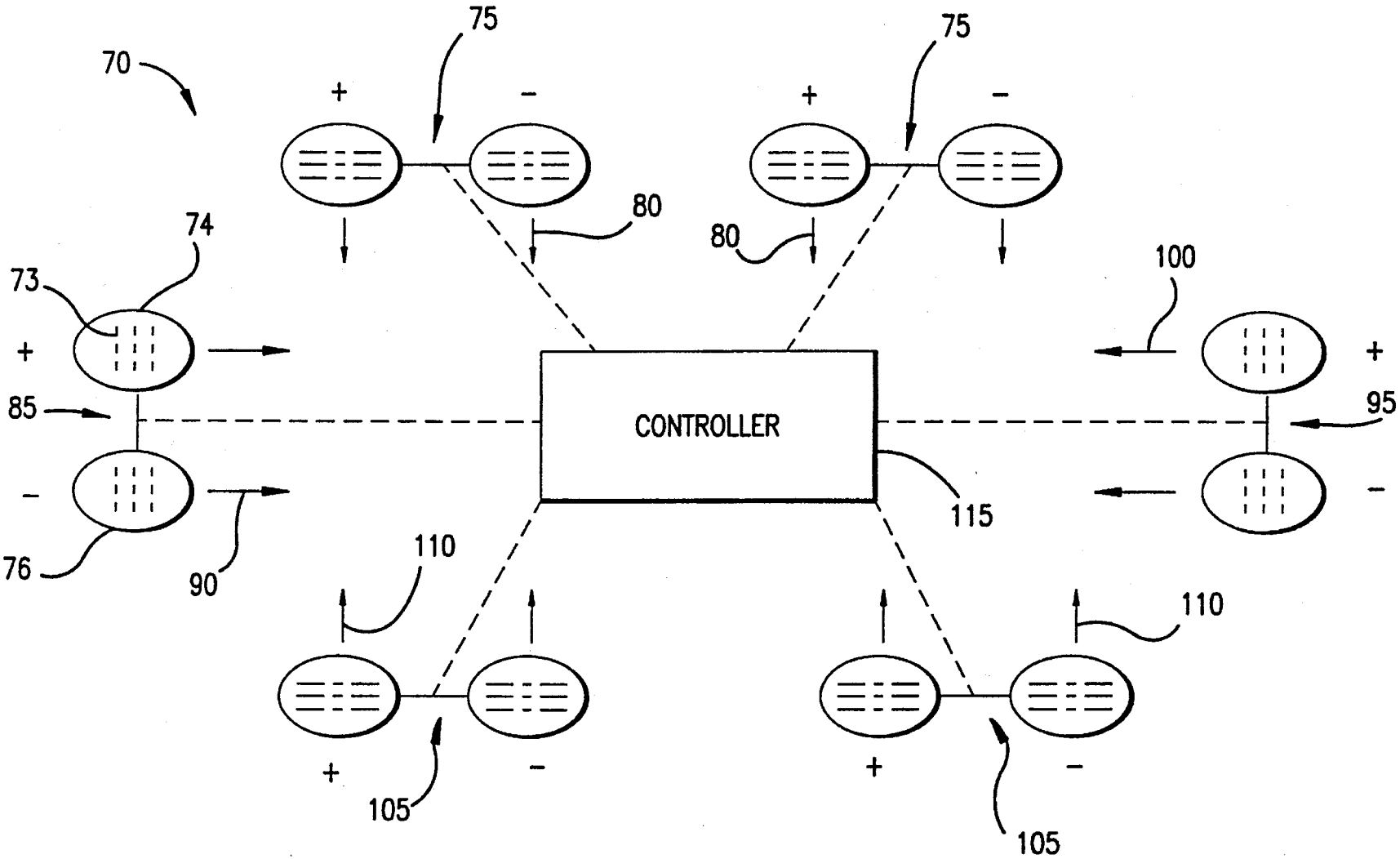
FIG. 6 is a top view showing banks of vibrators according to an embodiment of the invention.

FIG. 6 illustrates an arrangement of drive units 74, 76 according to the invention, such as the drive units of FIGS. 2–3 and 4–5. Banks 75, 85, 95, 105 of drive units are arranged so that ratchets 73 of the drive units advance a substrate in the direction of arrows 80, 90, 100, or 110. Each bank of drive units in FIG. 6 includes two drive units 74, 76 and forms a two-phase system. The two drive units 74, 76 of a particular bank are separated by a distance of approximately 5ram and are supported by a common substrate.

Controller 115, which preferably is a microcomputer, directs drive unit 74 of each bank to vibrate out of phase with the other drive unit 76 of each bank. In other words, for each bank, the support member of drive unit 74 moves away from the substrate while the support member of drive unit 76 moves toward the substrate, as indicated by the "+" and "–" symbols of FIG. 6. Vibration in a two-phase system will be further described with reference to FIG. 8.

The FIG. 6 embodiment can advance a substrate in a number of different linear and rotational directions, not just in the directions indicated by arrows 80, 90, 100 and 110. Controller 115 selectively directs different ones of the banks to operate simultaneously or individually for varying time periods, as necessary to direct a substrate along a desired path. For example, to move a substrate in a linear direction from top to bottom as viewed in FIG. 6, controller 115 directs banks 75 to vibrate, moving the substrate in the direction of arrows 80. Alternatively, selected banks can be actuated to move the substrate linearly in a diagonal direction as viewed in FIG. 6. Controller 115 also can direct the rightmost one of banks 105 to vibrate, together the leftmost one of banks 75, for example, to impart rotational motion to the substrate. Further, controller 115 can direct the leftmost and rightmost banks 105, for example, to vibrate at different speeds to steer the substrate as desired. By actuating selected banks, controller 115 can precisely direct movement of the substrate forward and backward in numerous linear and/or rotational directions.

For printing applications, controller 115 can move a sheet in steps, from pixel to pixel, in printers with a sparse array of printing cells, for example. Further, controller 115 can direct multiple passes of the sheet past the printing cells, and can direct reverse motion to back out of a paper jam.

Figure 7:
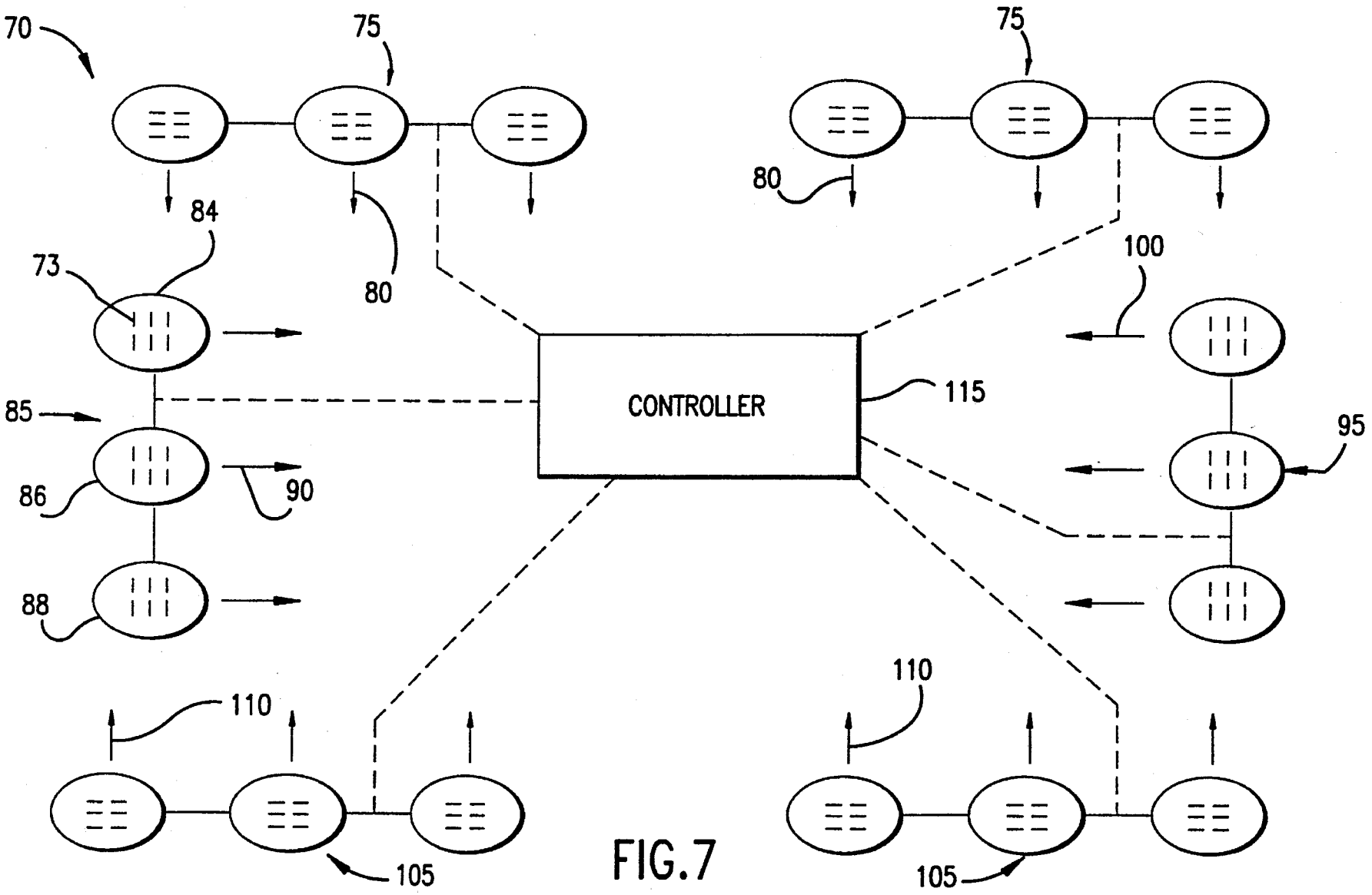
FIG. 7 is a top view showing banks of vibrators according to another embodiment of the invention.

FIG. 7 illustrates an arrangement of drive units according to an alternative embodiment. The FIG. 7 embodiment parallels that of FIG. 6, but each of the FIG. 7 banks includes three drive units 84, 86, 88 instead of two drive units 74, 76. Controller 115 directs drive units 84, 86, 88 of each bank to vibrate out of phase with each other, as will be further described with reference to FIG. 9.

Of course, any number of drive units can be combined in a single bank and driven out of phase with each other. Further, although FIGS. 6–7 illustrate linear alignment of the drive units of each bank, non-linear configurations also are possible. For example, the drive units of each bank can be arranged in triangular, square or polygonal shapes. Still further, the overall pattern of banks need not be rectangular, as in FIGS. 6–7. A wide variety of overall patterns can be used according to embodiments of the invention.

Figure 8:
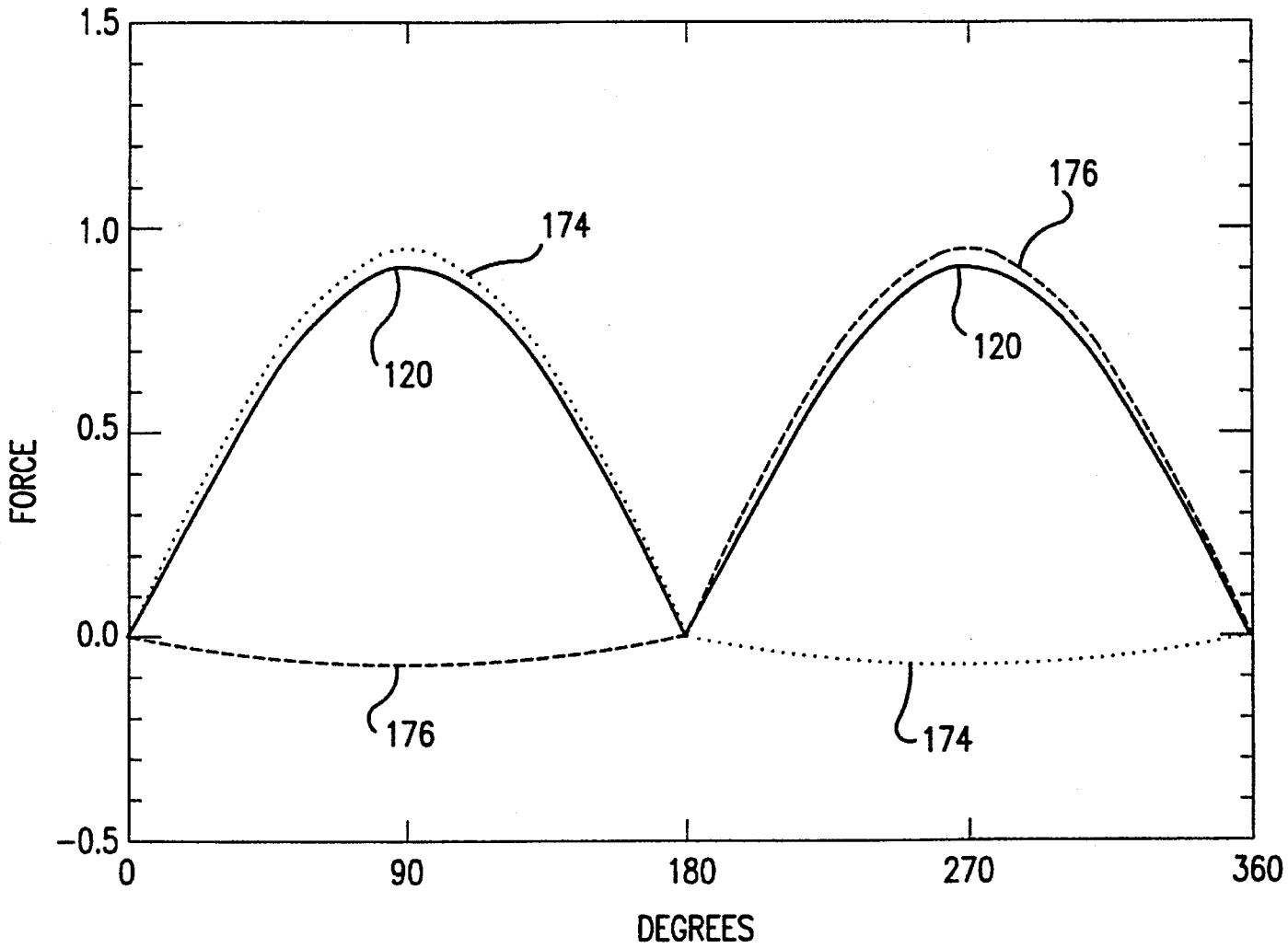
FIG. 8 is a phase diagram for a two-phase system according to an embodiment of the invention.
Figure 9:
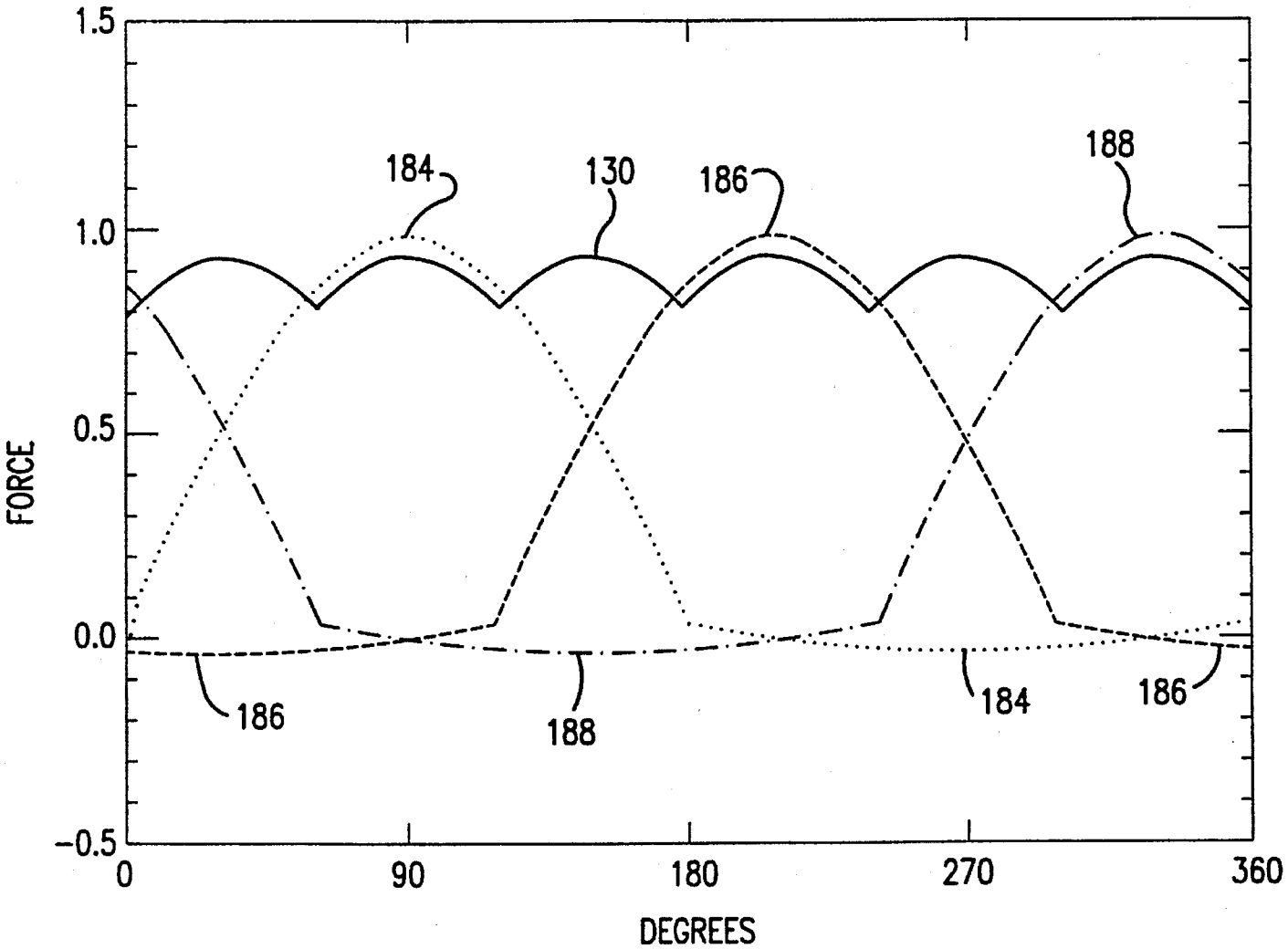
FIG. 9 is a phase diagram for a three-phase system according to an embodiment of the invention.
Figure 10:
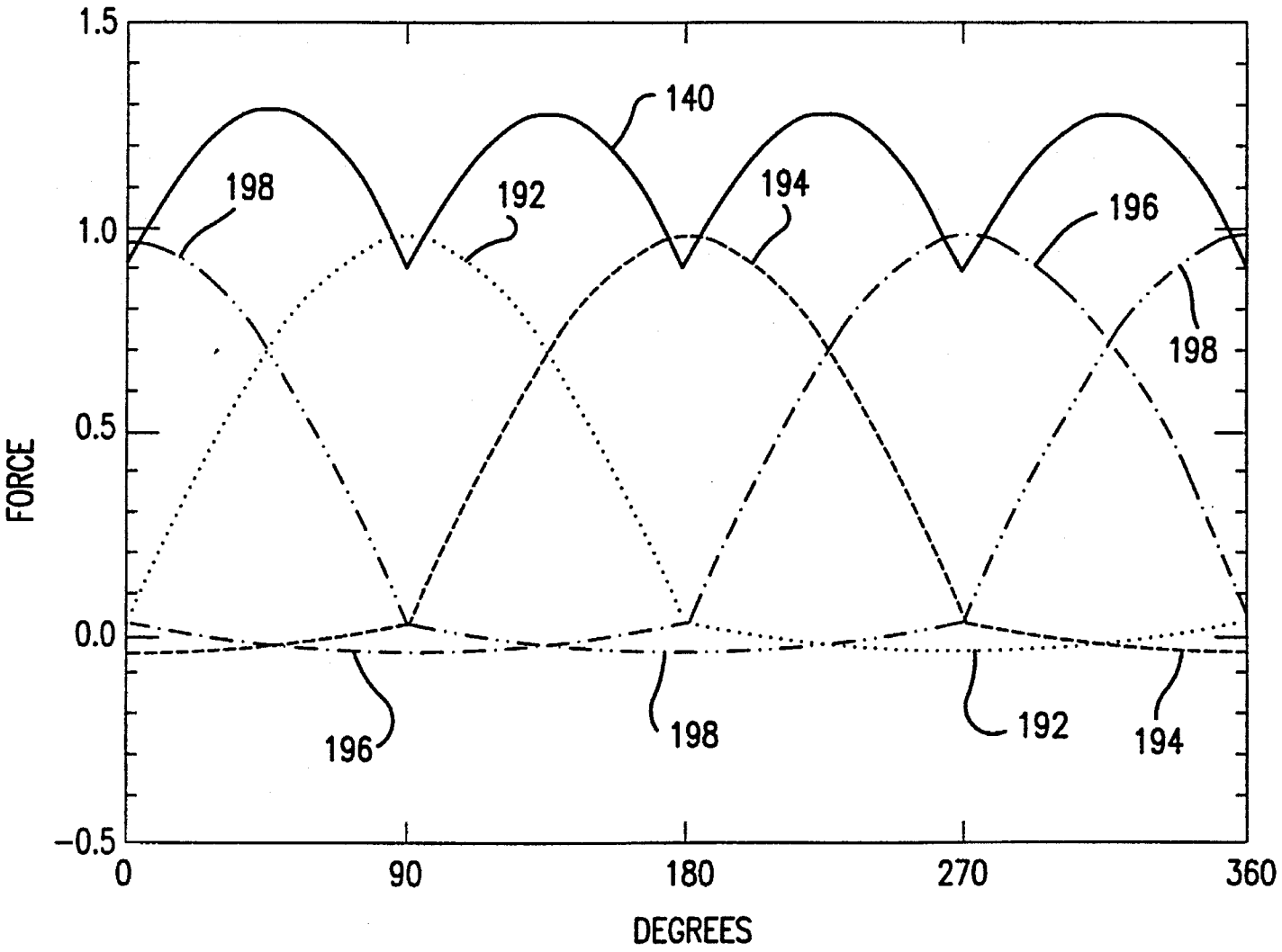
FIG. 10 is a phase diagram for a four-phase system according to an embodiment of the invention.

FIGS. 8–10 are phase diagrams showing the force applied to a substrate by ratchets of the drive units in two-phase, three-phase and four-phase systems. FIG. 8 corresponds to the two-phase systems of FIG. 6, and FIG. 9 corresponds to the three-phase systems of FIG. 7.

As shown in FIG. 8, drive unit 74 of each FIG. 6 bank exerts force 174 on the substrate overtime. As the base element of drive unit 74 moves toward the substrate between 0 and 180 degrees, the ratchets of drive unit 74 exert a positive force on the substrate. After the base element reaches the bottom of its stroke at 180 degrees, the base element moves away from the substrate, causing the ratchets to slip with respect to the substrate and to apply a slight negative force on the substrate. Thus, between 180 and 360 degrees in FIG. 8, force 174 is slightly negative.

Also as shown in FIG. 8, drive units 74, 76 of each bank vibrate out of phase with each other. Between 0 and 180 degrees, the base element of drive unit 74 moves toward the substrate to apply positive force 174, to the substrate. Simultaneously, the base element of drive unit 76 moves away from the substrate and applies a nominal negative force 176 that is, a force opposite to the direction of advancement, to the substrate. At 180 degrees, the direction of motion of the base elements reverses and, consequently, forces 174, 176 also reverse.

Positive force 174 overcomes nominal negative force 176 to yield a net positive force 120 on the substrate. Drive units 74, 76, therefore, together advance the substrate in the direction of orientation of the bank of drive units 74, 76.

FIG. 9 is a phase diagram for a three-phase system and corresponds to FIG. 7. Drive units 84, 86 and 88 operate out of phase to exert forces 184, 186, 188 on the substrate. A resulting positive net force 130 advances the substrate in the direction in which the bank of drive units 84, 86, 88 is oriented. Similarly, FIG. 10 illustrates forces 192, 194, 196, 198 applied by the drive units of a four-phase system, yielding a net positive force 140 to advance the substrate. Of course, five-phase and higher-phase systems are also possible. Higher phase systems yield more uniform net forces. Net force 140 for the four-phase system of FIG. 10, for example, is more uniform than net force 130 for the three-phase system of FIG. 9.

FIGS. 11–17 illustrate the formation of the ratchets on the previously described base elements, according to embodiments of the invention.

Figure 11:
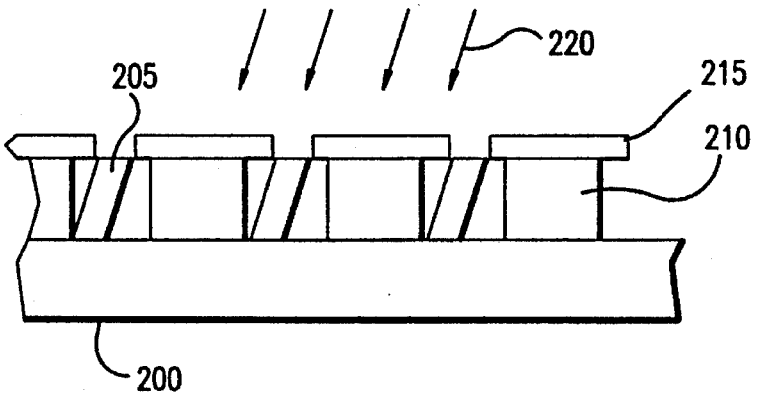
FIG. 11 is a side view showing formation of ratchets according to an embodiment of the invention.

According to the FIG. 11 embodiment, masking material 210, 215 first is applied to base element 200. Masking material 210, 215 can be one thick layer of PMMA. Alternatively, material 210, 215 can be a layer of PMMA with an overlying thin layer of metal that protects the PMMA during the prolonged etching process. Evaporated ratchet material then is deposited, by any suitable anisotropic deposition process, on base element 200 at an oblique angle, as indicated by arrows 220. Masking material 210, 215 partially blocks the evaporated ratchet material as it settles toward base element 200, thereby forming ratchets 205 at an oblique angle on base element 200. The evaporated ratchet material for forming ratchets 205 preferably is nickel.

Figure 12:
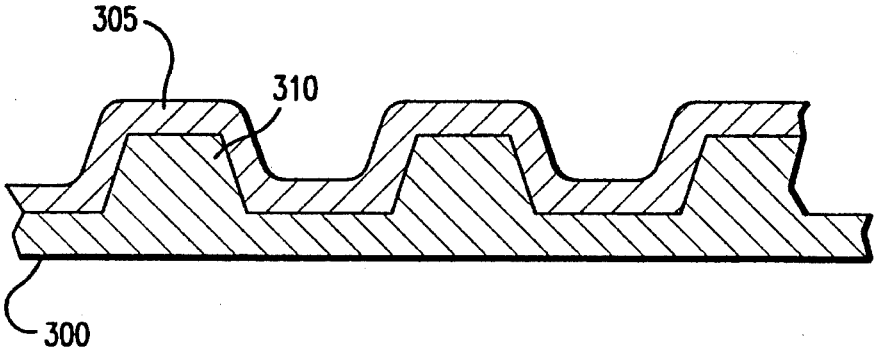
FIGS. 12–13 are cross-sectional views showing formation of ratchets according to another embodiment of the invention.
Figure 13:
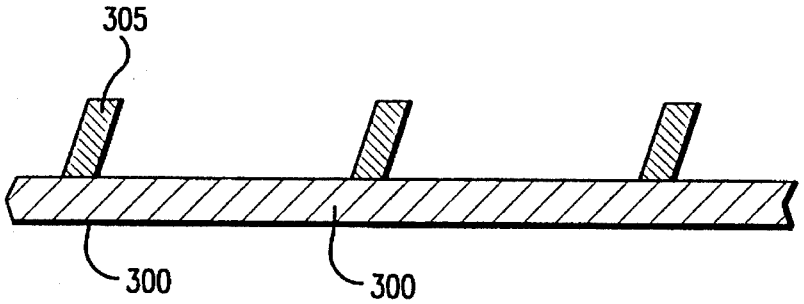

According to the embodiment of FIGS. 12–13, base element 300, preferably formed of <100> silicon, is anisotropically etched to form ridges 310. Ratchet material 305 is deposited over base element 300, including ridges 310, to form a zig-zag pattern on base element 300, as illustrated in FIG. 12. Ratchet material 305 and ridges 310 then are selectively removed, by lithography or an equivalent process, leaving angled ratchets 305 on base element 300, as illustrated in FIG. 13.

Figure 14:
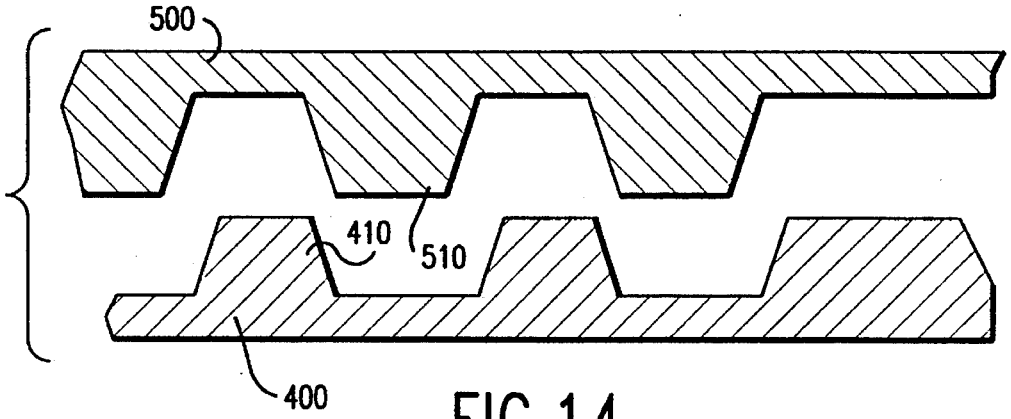
FIGS. 14–17 are cross-sectional views showing formation of ratchets according to another embodiment of the invention.
Figure 15:
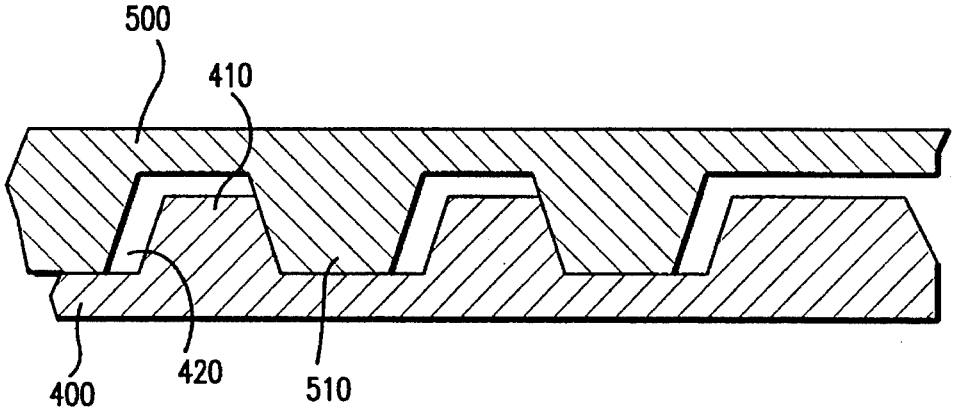
Figure 16:
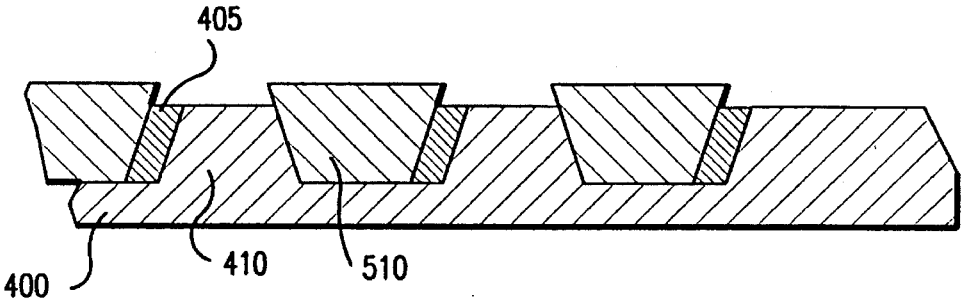
Figure 17:
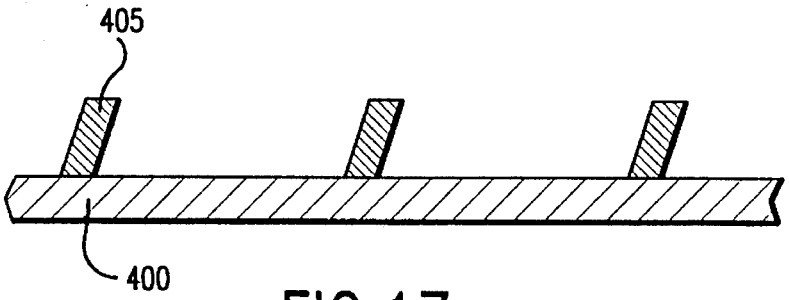

According to the embodiment of FIGS. 14–17, base element 400 and a similar element 500, both preferably formed of <100> silicon, are anisotropically etched to different depths, leaving ridges 410, 510 of different heights, as shown in FIG. 14. Elements 400, 500 are bonded together, such as by silicon fusion bonding, to form gaps 420 between elements 400, 500, as shown in FIG. 15. The non-ridge portions of element 500 then are etched away, leaving ridges 510 in contact with substrate 400 but opening up gaps 420. Ratchet material 405 then is deposited on base element 400, preferably by electroplating or other suitable deposition processes, to fill in gaps 420, as shown in FIG. 16. Finally, ridges 410, 510 are etched away to leave angled ratchets 405 on substrate 400, as shown in FIG. 17.

Devices and methods according to the invention yield a number of advantages, including far higher speeds and far greater precision than are achievable with previous devices. According to embodiments of the invention, movement of a substrate such as paper can be precisely controlled to within microns of a desired position, even when the substrate is advanced at high speed. For sheets of paper, for example, speeds of at least 25–50 centimeters/second, and potentially up to at least 1 meter/second, are achievable. Thus, embodiments of the invention are particularly applicable to high-speed printing devices, such as acoustic ink printing devices.

Further, paper feeders according to the invention are far more compact than previously possible, because motors, rollers, bearings and other mechanical components associated with roller-type feeders are unnecessary. Embodiments of the invention have particular application, therefore, to portable printing and photocopying devices and desktop publishing systems, for example. Additionally, embodiments of the invention also are more efficient, requiring relatively little power input, and quieter than many previous devices.

While the invention has been described with reference to specific embodiments, the description is illustrative and is not to be construed as limiting the scope of the invention. For example, instead of resiliently deformable ratchets, rigid ratchets pivoted at the base element can be used. Various other modifications and changes may occur to those skilled in the art without departing from the spirit and scope of the invention.

What is claimed is:

1. A device for moving an object, the device comprising:

a base element;

a drive mechanism coupled with the base element to move the base element in first and second directions; and a plurality of movable members formed of an electrodeposited material fixedly secured to the base element to move with the base element, the members being in contact with the object such that movement of the base element in the first direction causes the members to change configuration to move the object in a direction other than the first direction, and such that movement of the base element in the second direction causes the members to reverse the change in configuration and to slip with respect to the object.

2. The device of claim 1, wherein the movable members comprise resiliently deformable members in contact with the object such that movement of the base element in the first direction causes the members to resiliently deform to move the object in the direction other than the first direction.

3. The device of claim 1, wherein the drive mechanism comprises a vibrator coupled with the base element to vibrate the base element.

4. The device of claim 3, wherein the vibrator comprises a piezo-vibrator.

5. The device of claim 3, wherein the vibrator vibrates the base element at a resonant frequency of the base element.

6. The device of claim 1, further comprising:

a plurality of base elements;

a plurality of drive mechanisms, one drive mechanism being coupled with each base element;

a plurality of movable members fixedly secured to each base element and in contact with the object; and a controller operatively connected with the drive mechanisms to move at least one of the base elements in the first direction while moving at least one other of the base elements in the second direction.

7. The device of claim 1, wherein the plurality of movable members comprises at least one hundred movable members fixedly secured to the base element.

8. The device of claim 1, wherein each movable member is less than one millimeter in length.

9. The device of claim 1, wherein the movable members are in contact with the object such that movement of the base element in the first direction causes the members to move the object in a direction substantially perpendicular to the first direction.

10. The device of claim 1, wherein the movable members are formed of a material deposited in an evaporated state at an oblique angle onto the base element.

11. The device of claim 1, wherein the movable members are in contact with the object such that movement of the base element in the first direction causes the members to move the object away from the base element.

12. The device of claim 1, wherein the members are in contact with the object such that movement of the base element in the first direction causes the members to move the object in at least a linear direction other than the first direction.

13. An apparatus for advancing a substrate, the apparatus comprising:

a bank of drive units disposed with respect to the substrate so as to advance the substrate, the drive units each including a support member mounted for vibratory movement, a vibrator coupled with the support member to vibrate the support member, and ratchet means coupled with the support member for engaging the substrate to advance the substrate as the support member vibrates; and a controller operatively connected with the bank of drive units to direct the support member of a first of the drive units of the bank to vibrate out of phase with the support member of a second of the drive units of the bank so that the first drive unit advances the substrate out of phase with the second drive unit.

14. The apparatus of claim 13, further comprising a plurality of banks of said drive units, the banks being arranged to advance the substrate in different directions.

15. The apparatus of claim 14, wherein the banks are arranged to advance the substrate in a rotational direction.

16. The apparatus of claim 13, wherein the bank comprises at least three drive units, and further wherein the controller directs the support member of each drive unit to vibrate out of phase with the support members of the other drive units.

17. The apparatus of claim 13, wherein:

the ratchet means for engaging the substrate is frictionally engaged with the substrate as the vibrator moves the support member toward the substrate, to apply force to the substrate tending to advance the substrate in an advancement direction, and is slidably engaged with the substrate as the vibrator moves the support member away from the substrate, to apply force to the substrate tending to move the substrate in a direction opposite to the advancement direction; and the force tending to advance the substrate in the advancement direction is greater than the force tending to move the substrate in the direction opposite to the advancement direction.

18. A method of moving an object, the method comprising:

engaging the object with a plurality of movable members formed of an electrodeposited material fixedly secured to a base element;

moving the base element in a first direction to change the configuration of the movable members, thereby causing the object to move in a direction other than the first direction; and moving the base element in a second direction to reverse the change in configuration of the movable members, thereby causing the movable members to slip with respect to the object.

19. The method of claim 18, further comprising the steps of:

engaging the object with pluralities of movable members, each of the pluralities of movable members being fixedly secured to a respective one of a plurality of base elements;

moving a first base element of the plurality of base elements toward the object to move the object in the direction other than the first direction; and moving a second base element of the plurality of base elements away from the object;

wherein the step of moving the first base element and the step of moving the second base element occur simultaneously.

* * * * *